US007373693B2

(12) United States Patent
Markl et al.

(10) Patent No.: US 7,373,693 B2
(45) Date of Patent: May 20, 2008

(54) HINGE ASSEMBLY

(75) Inventors: Norbert A. Markl, Placentia, CA (US); John M. Kosidlo, White Lake, MI (US); Lawrence W. Johnson, Taylor, MI (US); Richard K. Mitts, Fullerton, CA (US); Paul J. Dunbar, Brighton, MI (US)

(73) Assignee: Illinois Tool Works Inc., Glenview, IL (US)

( * ) Notice: Subject to any disclaimer, the term of this patent is extended or adjusted under 35 U.S.C. 154(b) by 231 days.

(21) Appl. No.: 11/225,592

(22) Filed: Sep. 13, 2005

(65) Prior Publication Data

US 2006/0112520 A1 Jun. 1, 2006

Related U.S. Application Data

(60) Provisional application No. 60/632,183, filed on Dec. 1, 2004.

(51) Int. Cl.
*E05D 11/06* (2006.01)

(52) U.S. Cl. ..... 16/374; 16/334

(58) Field of Classification Search ..... 16/328, 16/334, 335, 321, 374, 375, 344, 327, 50; 296/146.9, 146.11, 146.12; 292/275, 262, 292/73.75, DIG. 9
See application file for complete search history.

(56) References Cited

U.S. PATENT DOCUMENTS

| | | | | |
|---|---|---|---|---|
| 2,992,451 | A | 7/1961 | Schonitzer et al. | |
| 4,672,715 | A | 6/1987 | Beckwith | |
| 6,012,201 | A * | 1/2000 | Mitts et al. | 16/334 |
| 6,073,308 | A | 6/2000 | Linnenbrink et al. | |
| 6,481,056 | B1 * | 11/2002 | Jesse | 16/334 |
| 6,581,243 | B2 * | 6/2003 | Parizel | 16/334 |
| 6,629,334 | B2 * | 10/2003 | Huang | 16/50 |
| 7,203,996 | B2 * | 4/2007 | Linnenbrink et al. | 16/334 |
| 2002/0069481 | A1 | 6/2002 | Ashline et al. | |

* cited by examiner

*Primary Examiner*—Chuck Y. Mah
(74) *Attorney, Agent, or Firm*—Mark W. Croll; Paul F. Donovan

(57) ABSTRACT

A hinge assembly includes a door hinge housing configured to be mounted to a door, a body hinge housing configured to be mounted to a stationary object, and a check assembly including a spring. The body hinge housing is pivotally secured to the door hinge housing. The check assembly is covered by at least one of the door hinge housing and the body hinge housing.

19 Claims, 11 Drawing Sheets

HINGE ASSEMBLY

RELATED APPLICATIONS

This application relates to and claims priority benefits from U.S. Provisional Patent Application 60/632,183 entitled "Door Hinge With Integral Check Mechanism," filed Dec. 1, 2004, which is incorporated by reference herein in its entirety.

FIELD OF THE INVENTION

Embodiments of the present invention generally relate to a hinge system, and more particularly, to a hinge system configured for use with a door, such as an automobile door.

BACKGROUND OF THE INVENTION

Conventional door hinge systems, particularly automobile door hinges, include spring check mechanisms that assist in moving the door away from an open position to a fully closed position. Examples of such systems are shown and described in U.S. Pat. No. 4,800,624, entitled "Hinge With Elastomerically Supported Check Spring," and U.S. Pat. No. 6,012,201, entitled "Door Hinge System."

Typically, the spring check mechanisms are exposed within the door hinge systems. During painting and e-coat processes, the spring check mechanisms typically are not installed within the hinge systems, because such processes may damage the spring mechanisms. For example, wet or drying paint may alter the force constant of a particular spring and/or otherwise damage the spring. Thus, the spring check mechanisms are typically installed into the hinge systems after such processes, thereby adding another step in the total manufacturing process.

Additionally, typical hinge assemblies may present difficulties when one wants to open a door to put a large object or package in a vehicle. For example, if a car door only opens at a 45° angle, a person may find it difficult to move a large package, such as a purchased television set, into the vehicle for shipment home.

Thus, a need exists for a hinge assembly that includes a shielded spring check mechanism. Additionally, a need exists for a hinge assembly that may move through a wider range of motion than typical hinge assemblies.

SUMMARY OF THE INVENTION

Embodiments of the present invention provide a hinge assembly including a first hinge housing, such as a door hinge housing, a second hinge housing, such as a body hinge housing, and a check assembly. The first hinge housing may include an arcuate guide track having a plurality of detents, or dwells, separated by a plurality of ridges. The second hinge housing is pivotally secured to the first hinge housing and may include a mounting plate integrally formed with a check cover extending from the mounting plate. The first hinge housing may be configured to pivot 90° with respect to the second hinge housing.

The check assembly includes a first spring housing, a second spring housing, and a spring compressed between the first and second spring housings. The first spring housing may be fixed within the second hinge housing, while the second spring housing may be configured to move relative to the first spring housing. At least one of the first and second spring housings retains a roller axle having rollers. The rollers are configured to move over the guide track. The check cover substantially covers the check assembly.

Figure 1:
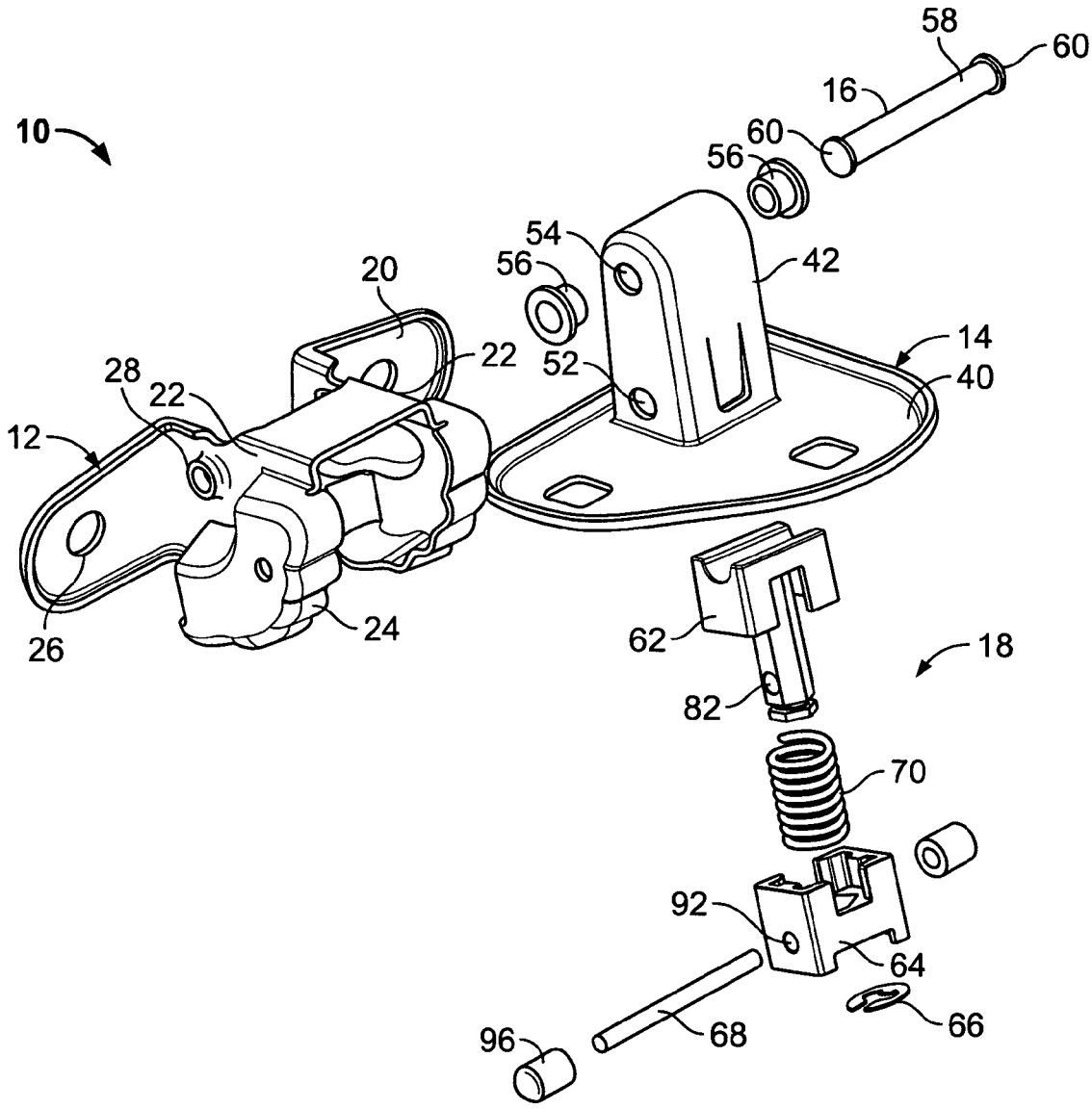
FIG. 1 illustrates an isometric exploded view of a hinge assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates an isometric exploded view of a hinge assembly 10 according to an embodiment of the present invention. The hinge assembly 10 may be formed of various metals and/or plastics. The hinge assembly 10 includes a door hinge housing 12 configured to be pivotally mounted to a body hinge housing 14 about a pivot pin 16. A check assembly 18 is configured to be securely retained within the body hinge housing 14.

Figure 2:
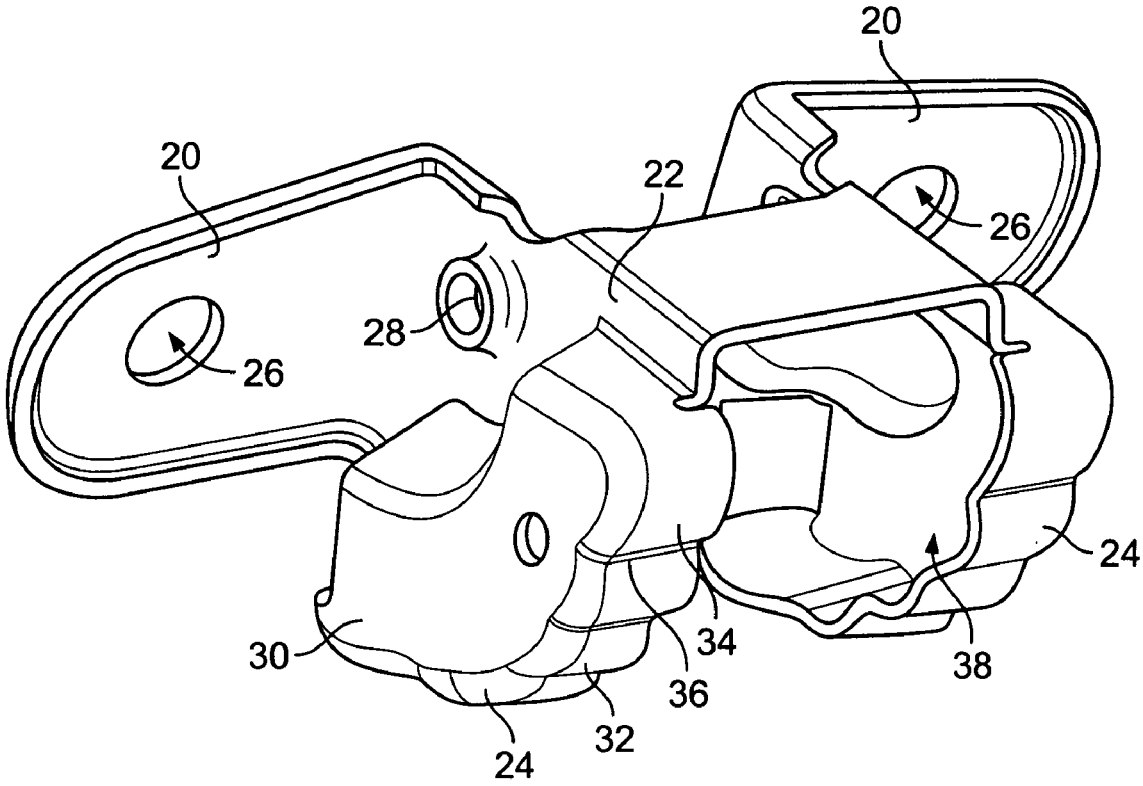
FIG. 2 illustrates an isometric view of a door hinge housing according to an embodiment of the present invention.

FIG. 2 illustrates an isometric view of the door hinge housing 12. The door hinge housing 12 includes mounting flaps, wings, or plates 20 integrally formed with pivot walls 22, which are in turn integrally formed with roller guide tracks 24.

The mounting flaps 20 include fastener through holes 26 that are configured to allow a fastener, such as a screw, to pass therethrough. The door hinge housing 12 is secured to a door, such as a door of an automobile, by way of fasteners securing the mounting flaps 20 to structure(s) within the door. Alternatively, the mounting flaps 20 may not include fastener through holes, but instead may be bonded, welded, or otherwise secured to the door. Also, alternatively, the door hinge housing 12 may include various other fastening structures, such as barbs, clasps, latches, snaps, or the like, in addition to, or in place of, the mounting flaps 20.

Each pivot wall 22 may be perpendicular with respect to the mounting flaps 20. Pivot pin passages 28 are formed through each pivot wall 22. The pivot pin passages 28 are aligned with one another and are configured to receive and slidably retain the pivot pin 16 (shown in FIG. 1).

Each roller guide track 24 includes a lateral wall 30 integrally formed with an arcuate front wall 32. The arcuate front wall 32 includes a series of detents or dwells 34 separated by creases, or ridges 36. A check chamber 38 is defined between the lateral wall 30 and the arcuate front wall 32. The roller guide tracks 24 are aligned with, and opposed to, one another and extend through an approximate 90° radial arc. Alternatively, the roller guide tracks 24 may extend over a shorter or longer arc, and may also include more or less dwells 34 than those shown.

Figure 3:
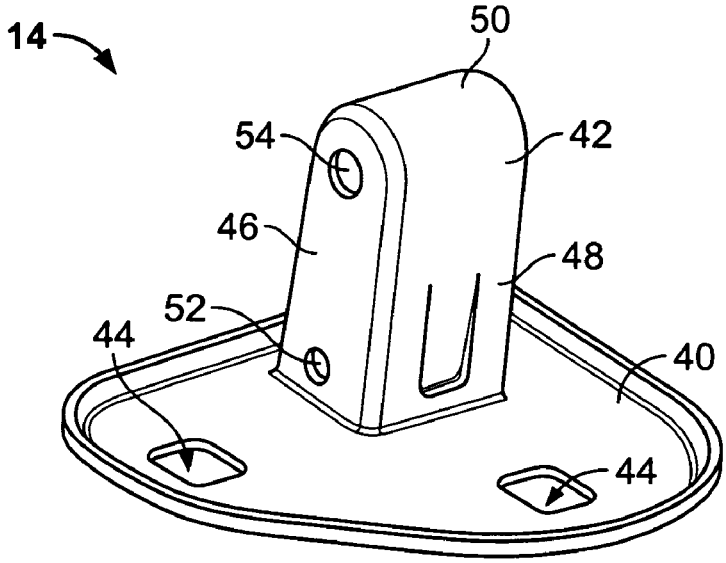
FIG. 3 illustrates an isometric view of a body hinge housing according to an embodiment of the present invention.

FIG. 3 illustrates an isometric view of the body hinge housing 14. The body hinge housing 14 includes a mounting plate 40 integrally formed with a check cover 42. The mounting plate 40 may include a plurality of fastener passages 44 formed therethrough. The body hinge housing 14 is secured to a fixed structure, such as a vehicle body, frame, panel, or the like, by way of fasteners securing the mounting plate 40 to the body structure. Alternatively, the mounting plate 40 may not include fastener passages, but instead may be bonded, welded, or otherwise secured to the body. Also, alternatively, the body hinge housing 14 may include various other fastening structures, such as barbs, clasps, latches, snaps, or the like, in addition to, or in place of, the mounting plate 40.

The check cover 42 upwardly extends from the mounting plate 40 and includes lateral walls 46 integrally formed with a front wall 48, a rear wall (not shown in FIG. 3), and a rounded top 50, defining a check chamber (not shown in FIG. 3) therebetween. A channel (not shown) is formed through the mounting plate 40 that provides an opening into the check chamber for the check assembly 18 to pass.

Roller axle passages 52 are formed through lower portions of the laterals walls 46. The roller axle passages 52 are aligned with one another and are configured to receive and slidably retain a roller axle (shown, for example, in FIG. 4). Similarly, pivot pin passages 54 are formed through upper portions of the lateral walls 46 and are configured to receive and slidably retain the pivot pin 16 (shown, for example, in FIG. 1).

Referring to FIGS. 1-3, the pivot pin 16 is slidably retained within the pivot pin passages 54 of the body hinge housing 14 and the pivot pin passages 28 of the door hinge housing 12. The check cover 42 is pivotally secured between the pivot walls 22 of the door hinge housing 12 by way of the pivot pin 16 passing through the pivot pin passages 28 and 54. Bushings 56 may be positioned within the pivot pin passages 28 and/or 54 in order to assist in guiding and securing the pivot pin 16 in place. The bushings 56 may also sealingly engage the pivot pin 16.

The pivot pin 16 includes a main longitudinal body 58 having end caps 60 disposed at distal ends. One or both of the end caps 60 may be removably secured to the pivot pin 16 in order to allow for ease of manufacture of the hinge assembly 10. That is, because the end caps 60 may have diameters larger than the pivot pin passages 28 and 54, one or both of the end caps 60 may be snapably, threadably, or otherwise removably secured to the main longitudinal body 58 so that the pivot pin 16 may pass through the pivot pin passages 28 and 54 during a manufacturing process. Once the pivot pin 16 is positioned in a final assembly position, the end cap(s) 60 is secured to a terminal end(s) of the main longitudinal body 58, thereby pivotally securing the door hinge housing 12 to the body hinge housing 14.

Figure 4:
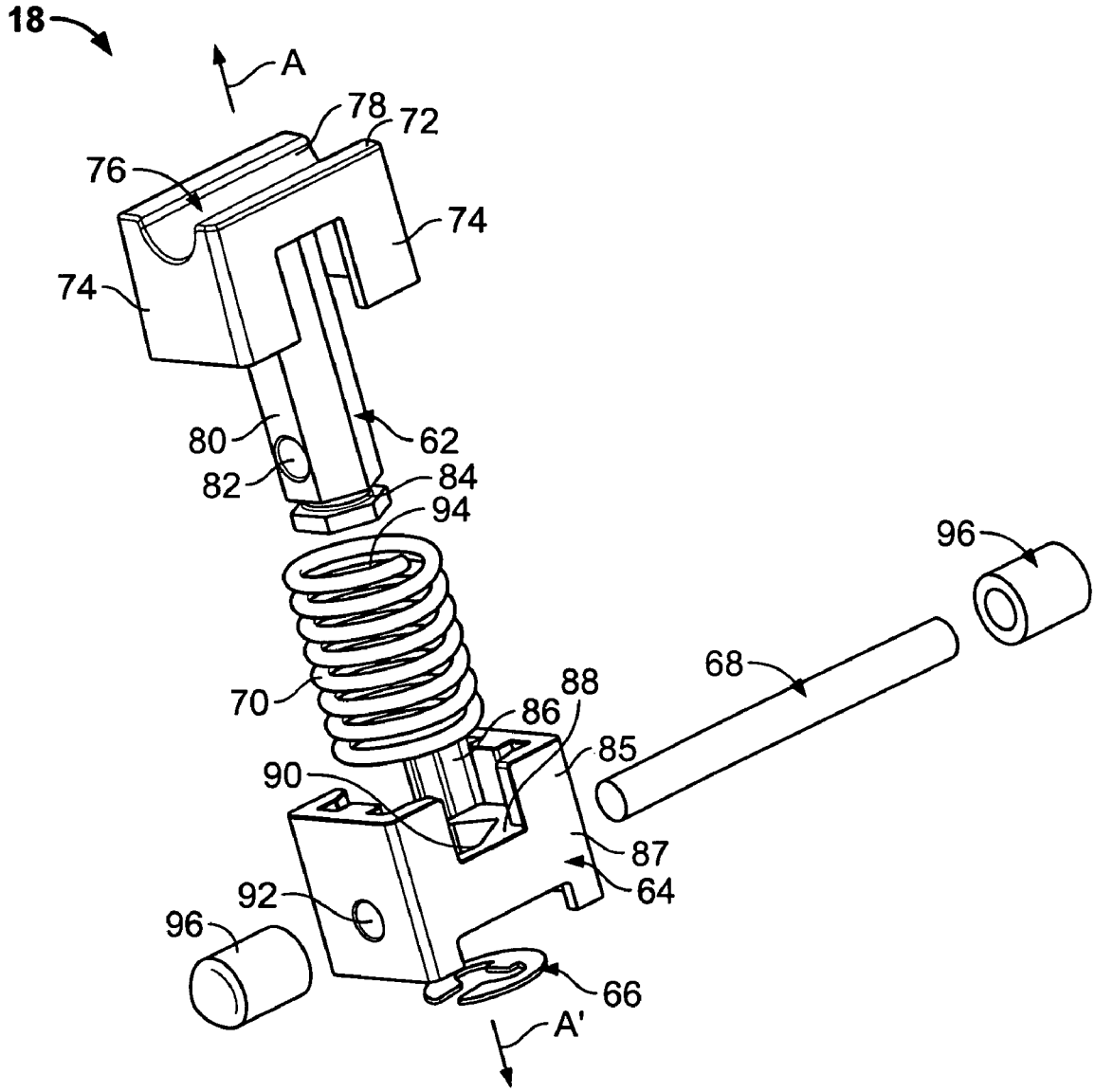
FIG. 4 illustrates an isometric exploded view of a check assembly according to an embodiment of the present invention.

FIG. 4 illustrates an isometric exploded view of the check assembly 18. The check assembly 18 includes an upper spring housing 62, a lower spring housing 64, a retaining clip 66, a roller axle 68, and a spring 70. The spring 70 is compressively retained between the upper and lower spring housings 62 and 64, while the roller axle 68 is rotatably secured by the lower spring housing 64 and the upper spring housing 62.

The upper spring housing 62 includes a top cap 72 having outer walls 74 integrally formed with a top surface 76 having a pivot pin channel 78. The pivot pin channel 78 is configured to abut the pivot pin 16 (shown in FIG. 1) when the check assembly 18 is positioned within the check cover 42 (shown in FIG. 3). A post 80 downwardly extends from an underside of the top surface 76. An axle passage 82 is formed proximate and through the lower end of the post 80, and a clip recess 84 is formed proximate a distal tip of the post 80.

The lower spring housing 64 includes outer walls 85 integrally formed with a base 87. A spring chamber 86 is defined between an upper surface 88 of the base 87 and interior surfaces of the outer walls 85. A post channel 90 downwardly extends through the base 87 and may pass entirely through the base 87. An axle passage 92 is formed transversely through the base 87 such that it is perpendicular to, and passes through, the post channel 90.

To assemble the check assembly 18, the spring 70 is positioned on the upper surface 88 of the base 87 so that its central opening 94 is aligned with the post channel 90. The post 80 is then positioned within the central opening 94 of the spring 70 such that the axle passage 82 is aligned in the same vertical plane as the axle passage 92 of the lower spring housing 64. The post 80 may be shaped to mate into the post channel 90 such that the post 80 may only be mated into the post channel 90 when the axle passage 82 is aligned in the same vertical plane as the axle passage 92. That is, the post 80 may include a specifically keyed shape, such as an octagon with a notch in one side, that mates with the post channel 90, which may include a reciprocal octagonal shape and a corresponding tab configured to mate with the notch.

As the upper spring housing 62 is urged toward the lower spring housing 64, the spring 70 is compressed between an underside of the top cap 72 and the upper surface 88 of the base 87. The upper spring housing 62 continues to be urged in this direction until the axle passage 82 of the post 80 aligns with the axle passage 92 of the base 87, thereby forming an unobstructed path, that is, an axle channel, therethrough. At this point, the clip recess 84 may extend through the bottom surface of the base 87. The retaining clip 66 may then clip around the clip recess 84, to ensure that the upper spring housing 62 remains secured to the lower spring housing 64.

The spring 70 exerts a force into the upper spring housing 62 in the direction of arrow A, while simultaneously exerting a force in the direction of arrow A' into the blower spring housing 64. While the upper and lower spring housings 62 and 64 may be urged toward one another, the force exerted by the resilient spring 70 causes the spring housings 62 and 64 to return to their original positions. The retaining clip 66 ensures that the force exerted by the spring 70 does not disconnect the upper spring housing 62 from the lower spring housing 64.

Figure 10:
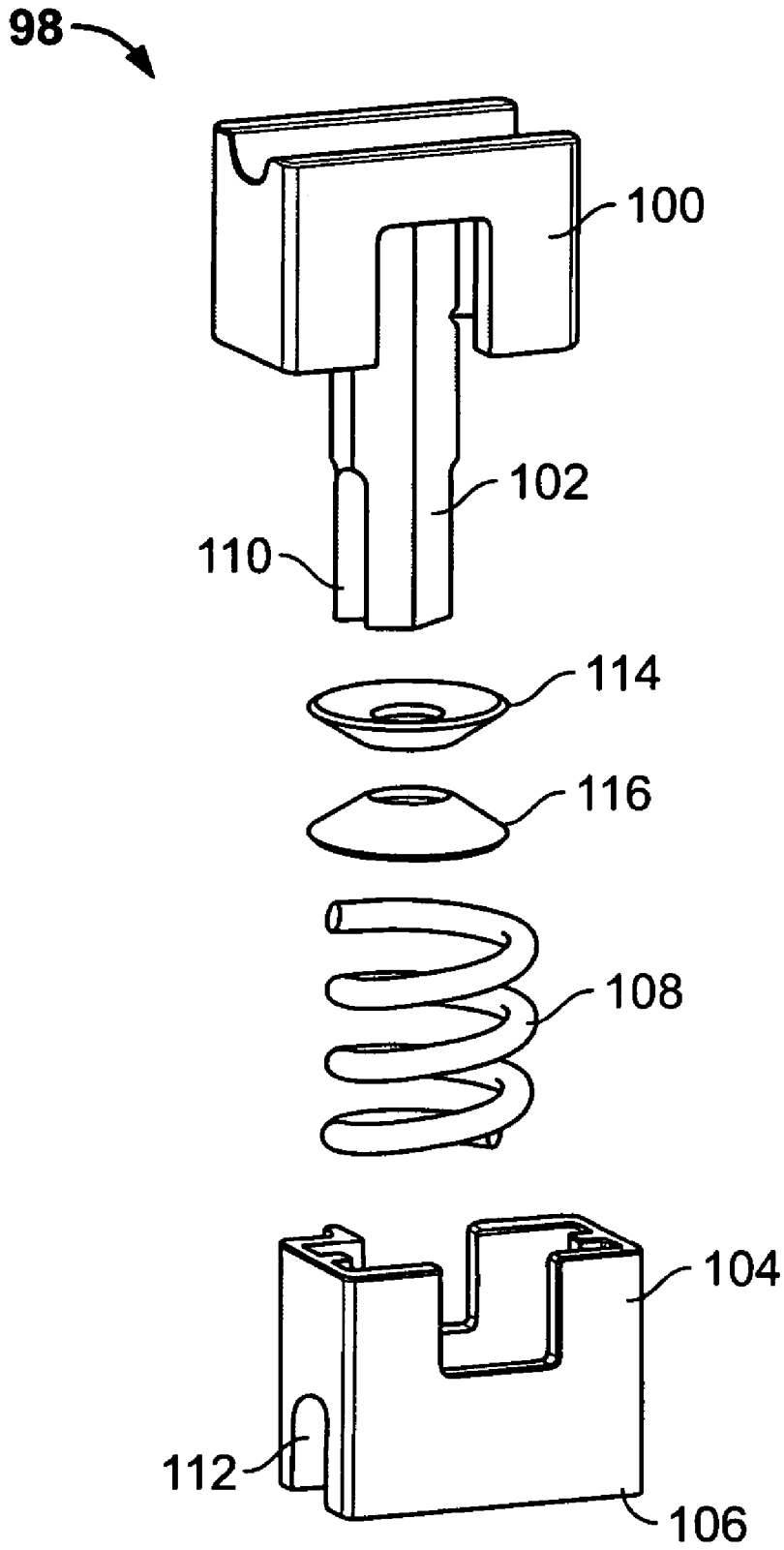
FIG. 10 illustrates an isometric exploded view of a check assembly according to an embodiment of the present invention.

Once the upper spring housing 62 is secured to the lower spring housing 64, the roller axle 68 is positioned within the axle channel defined by the axle passage 82 and the axle passage 92. The diameters of the axle passages 82 and 92 may be different in order to allow for limited relative movement between the spring housings 62 and 64 in the directions of arrows A and A' relative to one another when the roller axle 68 is positioned within the axle channel. For example, if the diameter of one of the axle passages 82 or 92 is larger than the other of the axle passages 82 or 92, the spring housings 62 and 64 may move relative to one another over a limited range of motion in the directions of arrows A and A' even when the roller axle 68 is within the axle channel defined by the axle passages 82 and 92. Optionally, as shown in FIG. 10, for example, one or both of the axle passages 82 and 92 may be slots that allow for the roller axle 68 to move therethrough in the direction of arrows A and A'.

Rollers 96 are secured to distal ends of the roller axle 68. For example, the rollers 96 may be threadably secured to the distal ends of the roller axle 68. Optionally, the rollers 96 may form an interference fit with the distal ends of the roller axle 68.

Figure 5:
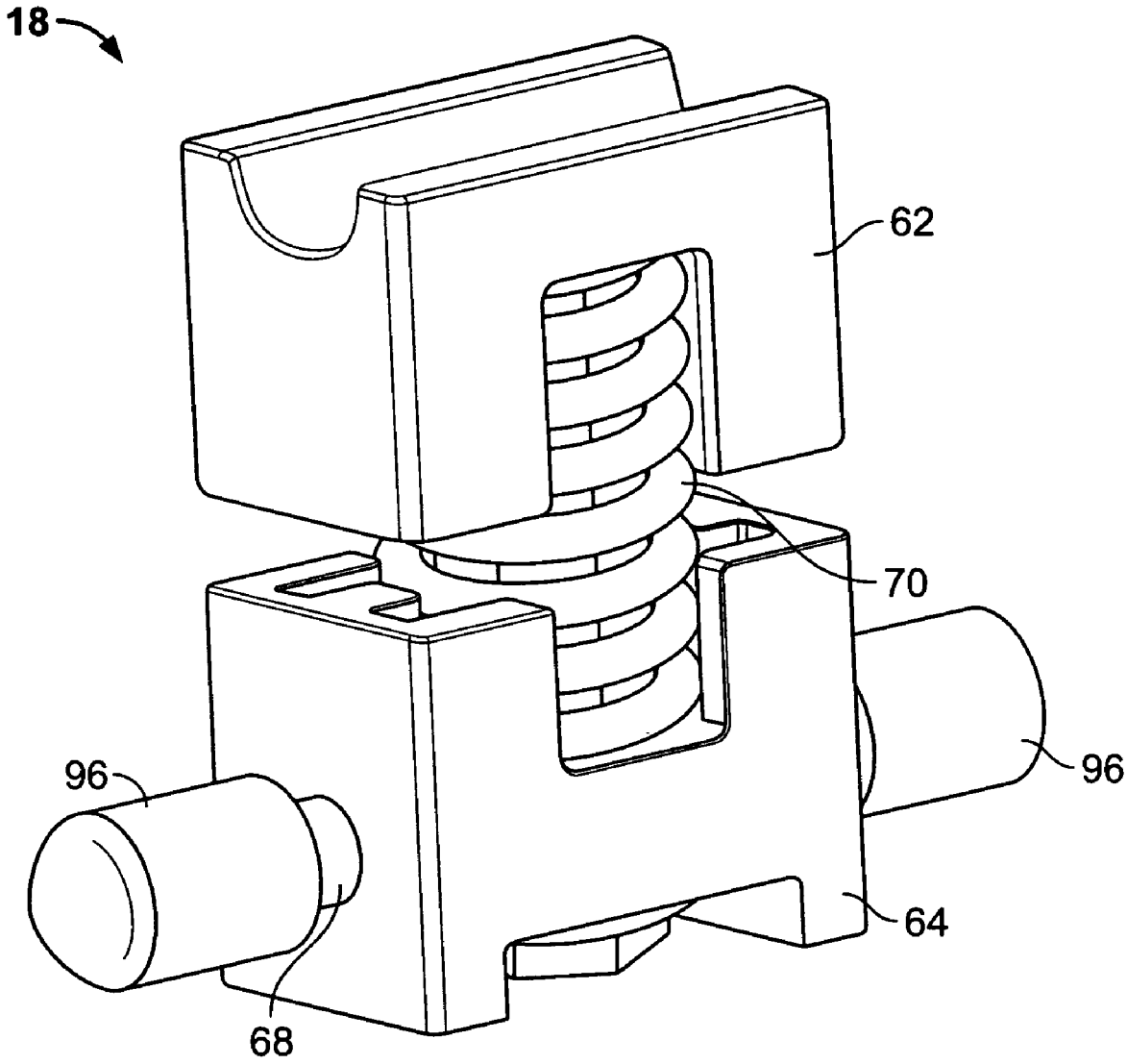
FIG. 5 illustrates an isometric view of a check assembly according to an embodiment of the present invention.

FIG. 5 illustrates an isometric view of the check assembly 18. As shown in FIG. 5, the upper spring housing 62 is movably secured to the lower spring housing 64. The spring 70 is compressed between the spring housing 62 and 64, while the roller axle 68 is slidably and rotatably secured within the axle channel, such that the rollers 96 extend from lateral walls of the base 87 of the lower spring housing 64.

Referring to FIGS. 1, 4, and 5, before the roller axle 68 is positioned through the axle channel defined by the axle passages 82 and 92, the upper housing 62, which is secured to the lower housing 64, with the spring 70 compressed therebetween, is moved into the check cover 42 through the check channel (not shown) formed through the underside of the mounting plate 40. Once the axle channel defined by the axle passages 82 and 92 is aligned with the roller axle passage 52 of the check cover 42, the roller axle 68 is positioned through the axle channel and the roller axle passages 52, thereby slidably and rotatably securing the roller axle 68 therein. The rollers 96 are then secured to the ends of the roller axle 68 and extend outwardly from the check cover 42.

The check cover 42 substantially covers the check assembly 18. That is, the check cover 42 protects outside elements, such as paint, from entering into the check chamber and contacting the check assembly 18.

As shown in FIG. 1, the spring 70 is oriented perpendicular with respect to the pivot pin 16. Thus, when the lower spring housing 64 moves relative to the upper spring housing 62, as discussed below, the lower spring housing 62 moves in directions that are perpendicular to the pivot pin 16.

Figure 6:
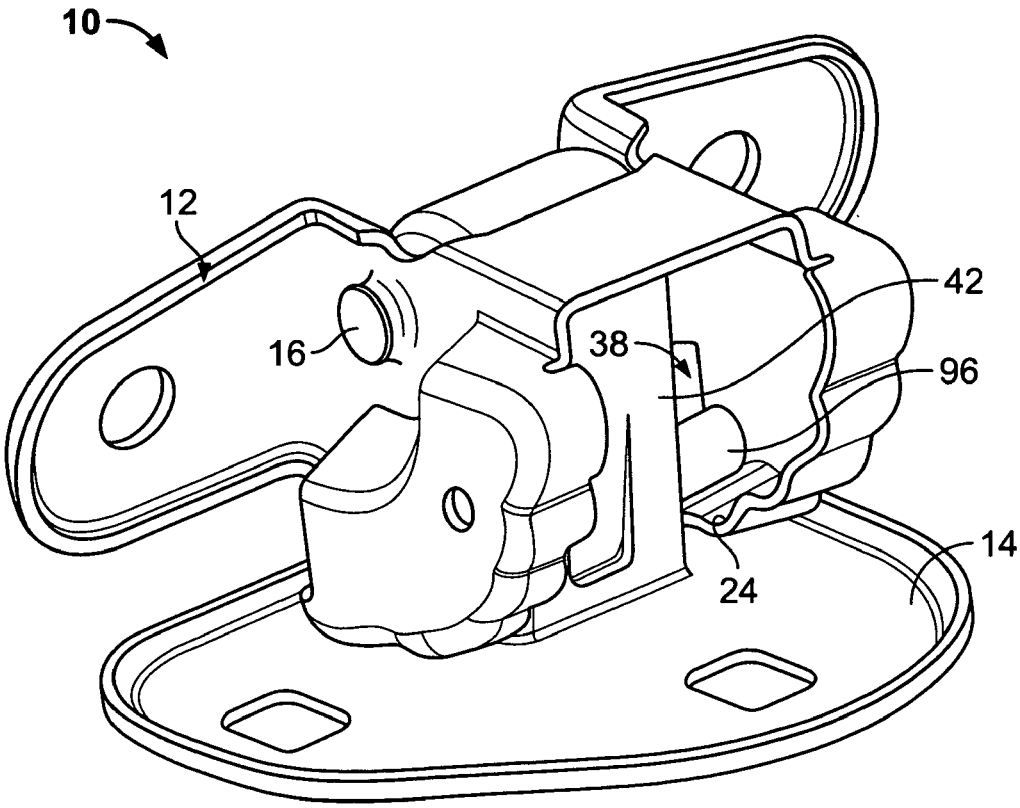
FIG. 6 illustrates an isometric view of a hinge assembly according to an embodiment of the present invention.

FIG. 6 illustrates an isometric view of the hinge assembly 10. The door hinge housing 12 is pivotally secured to the body hinge housing 14 through the pivot pin 16. The check cover 42 is positioned within the check chamber 38 such that the rollers 96 are positioned on the roller guide tracks 24. The door hinge housing 12 and the body hinge housing 14 may be drawn components, thereby allowing for greater flexibility in the hinge design. The door hinge housing 12, the body hinge housing 14, the pivot pin 16, and the check assembly 18 (mostly hidden by the check cover 42, except for the rollers 96) are integrally assembled into and make up the hinge assembly 10.

As discussed above, the hinge assembly 10 may be formed of various metals and/or plastics. For example, the door hinge housing 12 and the body hinge housing 14 may be formed of high carbon heat treated steel, thereby allowing these components to be manufactured from thinner gage material. The rollers 96 may be composed of a high temperature, high strength plastic, such as, for example, polyetheretherketone or PEEK, but may be made of various other materials, such as, for example, oil impregnated bronze materials and various other urethanes. Generally, the components of the hinge assembly 10 are formed from materials having high temperature resistance, tensile properties, and fatigue, stress, and crack resistance. The bushings 56 (shown, for example, in FIG. 1) may be formed of a material including sintered bronze. In general, the bushings 56 are configured to allow the door hinge housing 12 rotate about the pivot pin 16 in a desirable manner. In general, the components of the hinge assembly 10 are made from materials capable of withstanding e-coat temperatures.

Figure 7:
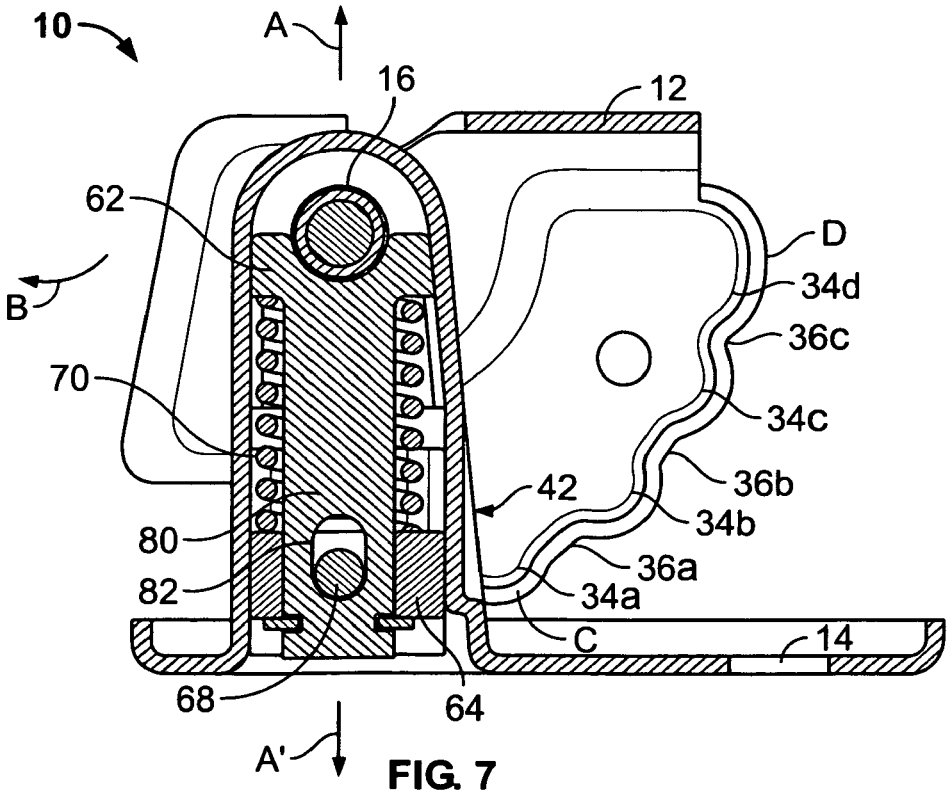
FIG. 7 illustrates a lateral cross-sectional view of a hinge assembly in a first position according to an embodiment of the present invention.
Figure 8:
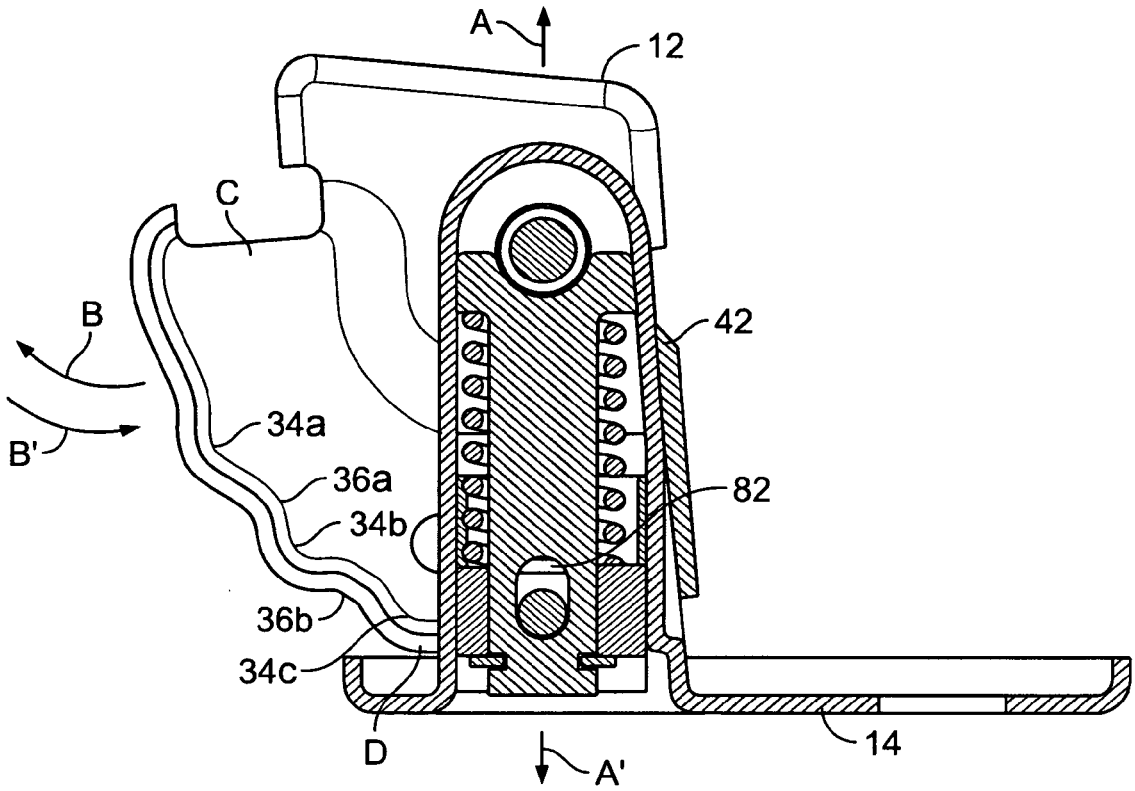
FIG. 8 illustrates a lateral cross-sectional view of a hinge assembly in a second position according to an embodiment of the present invention.
Figure 9:
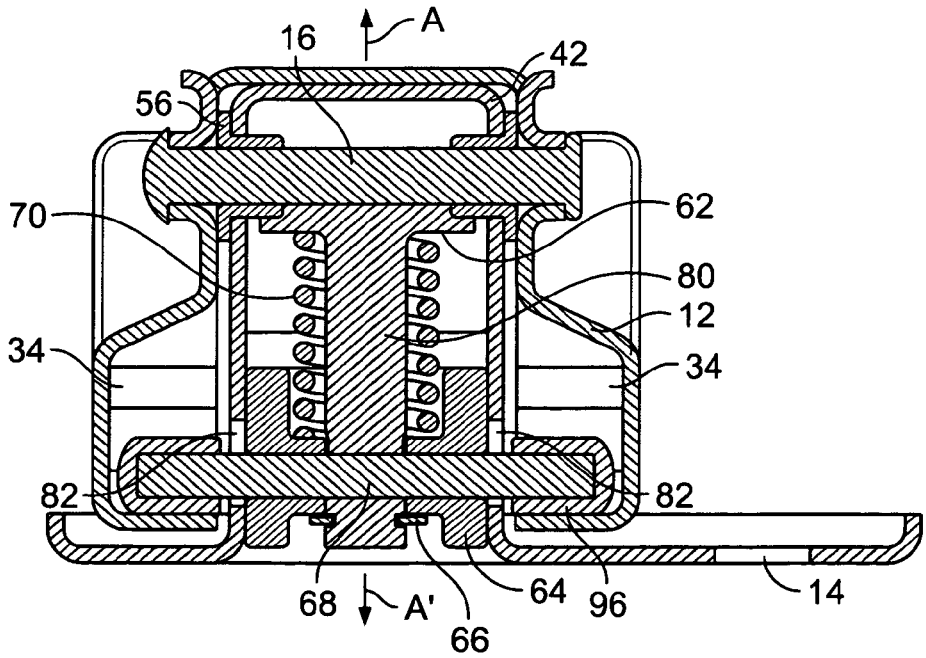
FIG. 9 illustrates a rear cross sectional view of a hinge assembly according to an embodiment of the present invention.

FIG. 7 illustrates a lateral cross-sectional view of the hinge assembly 10 in a first position, such as a closed position (that is, when a door is closed). FIG. 8 illustrates a lateral cross-sectional view of the hinge assembly 10 in a second position, such as a 90° open position. FIG. 9 illustrates a rear cross sectional view of the hinge assembly 10.

Referring to FIGS. 7-9, the rollers 96 (not shown in FIGS. 7 and 8) attached to the roller axle 68 are secured within a first dwell 34 (hidden by other components). Each dwell 34 acts as a limit stop for door movement. The force exerted by the spring 70 into the lower spring housing 64 retains the rollers in the dwells 34 when the door hinge housing 12 is not being swung in the direction of arrow B relative to the body hinge housing 14. At the same time, the force exerted by the spring 70 maintains the upper spring housing 62 in a fixed, abutting relationship with the pivot pin 16.

As the door is swung open in the direction of arrow B (that is, the door hinge housing 12 is swung in the direction of arrow B relative to the body hinge housing 14), the rollers 96 slide over the upwardly angled ridges 36. As the rollers 96 slide or roll over the ridges 36, the roller axle 68 slides through the axle passage 82 of the post 80 of the upper spring housing 62 toward the spring 70 in the direction of A. As such, the lower spring housing 64 moves relative to the upper spring housing 62 in the same direction, thereby compressing the spring 70. As the door hinge housing 12 continues to move in the direction of arrow B, the rollers 96 slide over the ridge 36, and the force exerted by the spring 70 in the direction of arrow A' into the lower spring housing 62 forces the lower spring housing 64 in the same direction and, consequently, the rollers 96 are forced into, and retained within, the next dwell 34.

As shown in FIGS. 7 and 8 in particular, the curvature of each dwell 34*a*, 34*b*, 34*c*, and 34*d* increases from C to D. That is, each ridge 36*a*, 36*b*, 36*c* becomes steeper from C to D. Thus, the swinging force in the direction of arrow B to move the rollers 96 into adjacent dwells 34 may increase as movement in the direction of arrow B increases. For example, a user may exert more swinging force in the direction of arrow B in order to position the rollers 96 from dwells 34*c* to 34*d*, than from dwells 34*b* to 34*c*. Thus, a user may need to exert more force to open a door wider, thereby safeguarding against widely opening a door too easily into close object. Alternatively, the curvature for a plurality of the dwells 34 may be the same The dwells 34 act as limit stops for door opening angles. As shown in FIGS. 7 and 8 in particular, the door hinge housing 12 includes five sets of dwells 34 (the first dwell being blocked by the body hinge housing 14. Thus, the hinge assembly 10 may be securely positioned at five different angles.

Because the check cover 42 is smaller than typical hinges, greater door opening angles are possible due to the fact that its small size provides less area for the door hinge housing 12 to abut. The small profile of the check cover 42 allows for a greater range of motion through the directions of arrows B and B'. As shown in FIG. 8, the door hinge housing 12 may be pivoted 90° relative to the body hinge housing 14.

FIG. 10 illustrates an isometric exploded view of a check assembly 98 according to an embodiment of the present invention. Similar to the check assembly 18, the check assembly 98 includes an upper spring housing 100 having a post 102, a lower spring housing 104 having a base 106, and spring 108 positioned between the upper spring housing 100 and the lower spring housing 104. The post 102, however, includes a slotted channel 110, instead of a circular axle passage 82 (shown, for example, in 4). Further, the base 106 includes a slotted channel 112 formed therethrough, instead of the axle passage 92 (shown, for example, in FIG. 4). The slotted channels 110 and 112 allow for a wider range of relative motion between spring housings 100 and 104 when the roller axle (shown, for example, in FIG. 4) is positioned therethrough. Additionally, a pair of opposed Bellville washers 114 and 116 are positioned around the post 102 above the spring 108. The Bellville washers 114 and 116 act to exert additional force into the spring 108 when the hinge assembly is rotated into a 90° open position. Additional Bellville washers, or other washers, may be positioned above and/or below the spring 108.

Figure 11:
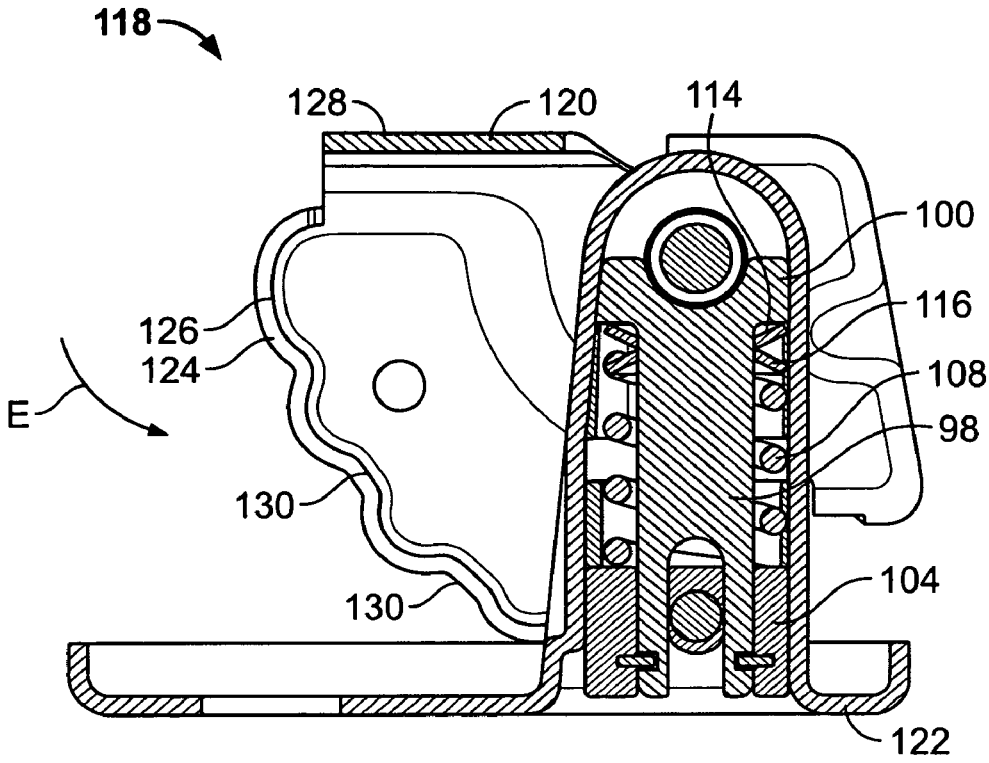
FIG. 11 illustrates a lateral cross-sectional view of a hinge assembly according to an embodiment of the present invention.

FIG. 11 illustrates a lateral cross-sectional view of a hinge assembly 118 according to an embodiment of the present invention. Similar to the hinge assembly 10 (shown, for example, in FIG. 1), the hinge assembly 118 includes a door hinge housing 120 pivotally connected to a body hinge housing 122, which cover the check assembly 98. The ridges 124 proximate the dwells 126 that are proximate the mounting flaps 128 may be steeper than the other ridges 130.

Figure 12:
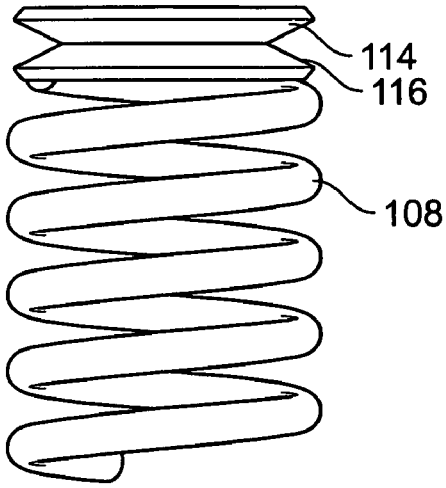
FIG. 12 illustrates a front view of a spring in a partially compressed state according to an embodiment of the present invention.

Referring to FIGS. 11 and 12, when the door hinge housing 120 is swung in the direction of E, as the rollers engage the closest ridges 130, the lower spring housing 104 is forced toward the upper spring housing 100, compressing the spring 108 as shown in FIG. 12.

Figure 13:
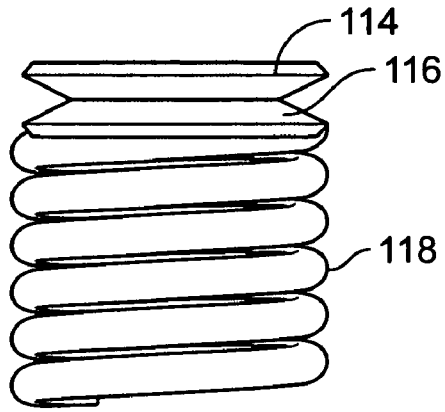
FIG. 13 illustrates a front view of a spring a fully-compressed state according to an embodiment of the present invention.

Referring to FIGS. 11 and 13, when the rollers engage the ridges 124, the spring 108 is fully compressed as shown in FIG. 13 because the ridges 124 are steeper and the rollers travel a steeper distance over them, thereby pushing the lower spring housing 104 further toward the upper spring housing 100. At this point, the Belleville washers 114 and 116 act to exert increased force toward the lower spring housing 104. More swinging force in the direction of E is used to move the rollers into over the ridges 124 and into the dwells 126, as compared to movement over the ridges 130, due to the full compression of the spring 108 and the increased force exerted by the Bellville washers 114 and 116. Thus, swinging the door hinge housing 120 into a 90° open position relative to the body hinge housing 122 takes more effort than swinging the door hinge housing 120 into other angular positions defined by the dwells 126.

Exerting increased effort in order to open a door at a 90° angle is useful due to the fact that a person typically may enter into a vehicle when a door is open at far less than a 90° open position. A door open at a 90° angle extends further away from the body of the vehicle. If it were too easy to open the door at such an angle, the door may accidentally hit an adjacent object or structure, such as, for example, a parked vehicle. However, opening the door at such an angle makes it easier to load large packages, bags, or other such objects into the vehicle.

Figure 14:
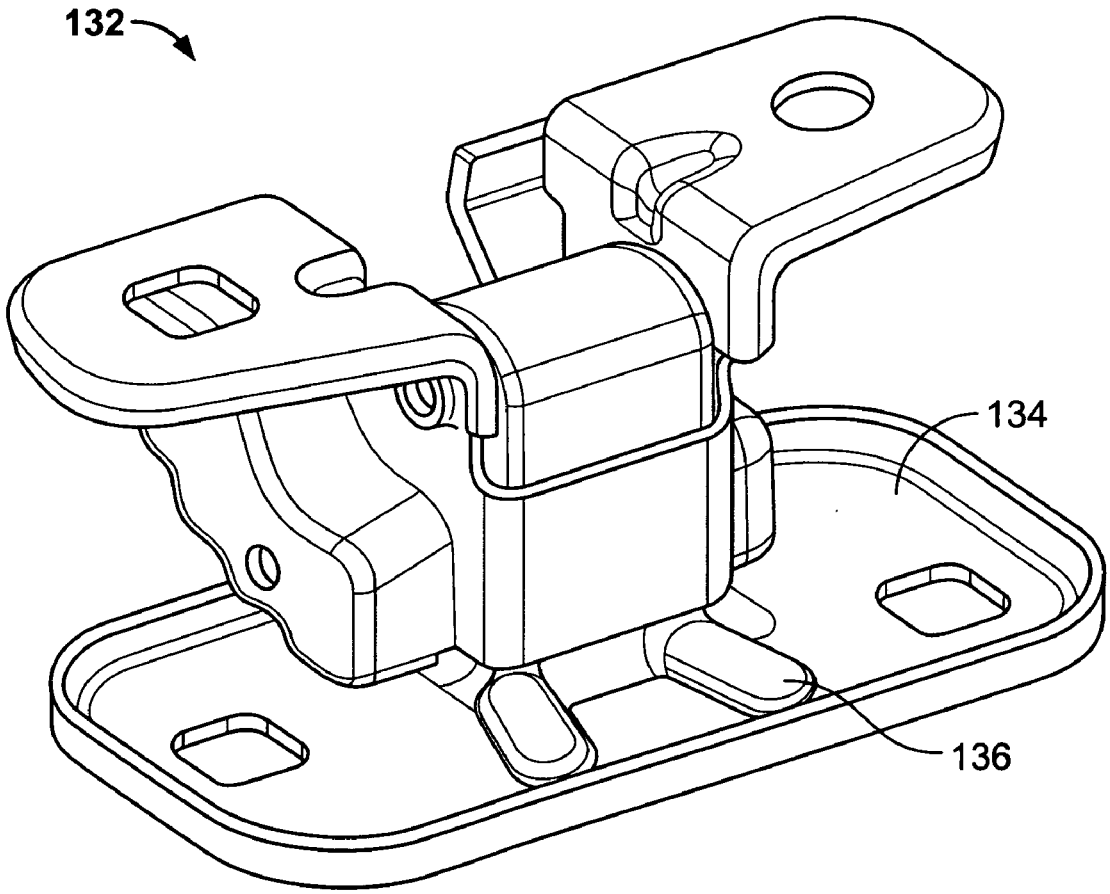
FIG. 14 illustrates a top isometric view of a hinge assembly according to an embodiment of the present invention.

FIG. 14 illustrates a top isometric view of a hinge assembly 132 according to an embodiment of the present invention. The hinge assembly 132 is similar to those described above except that mounting plate 134 includes stiffening beads 136 for increased structural support.

Figure 15:
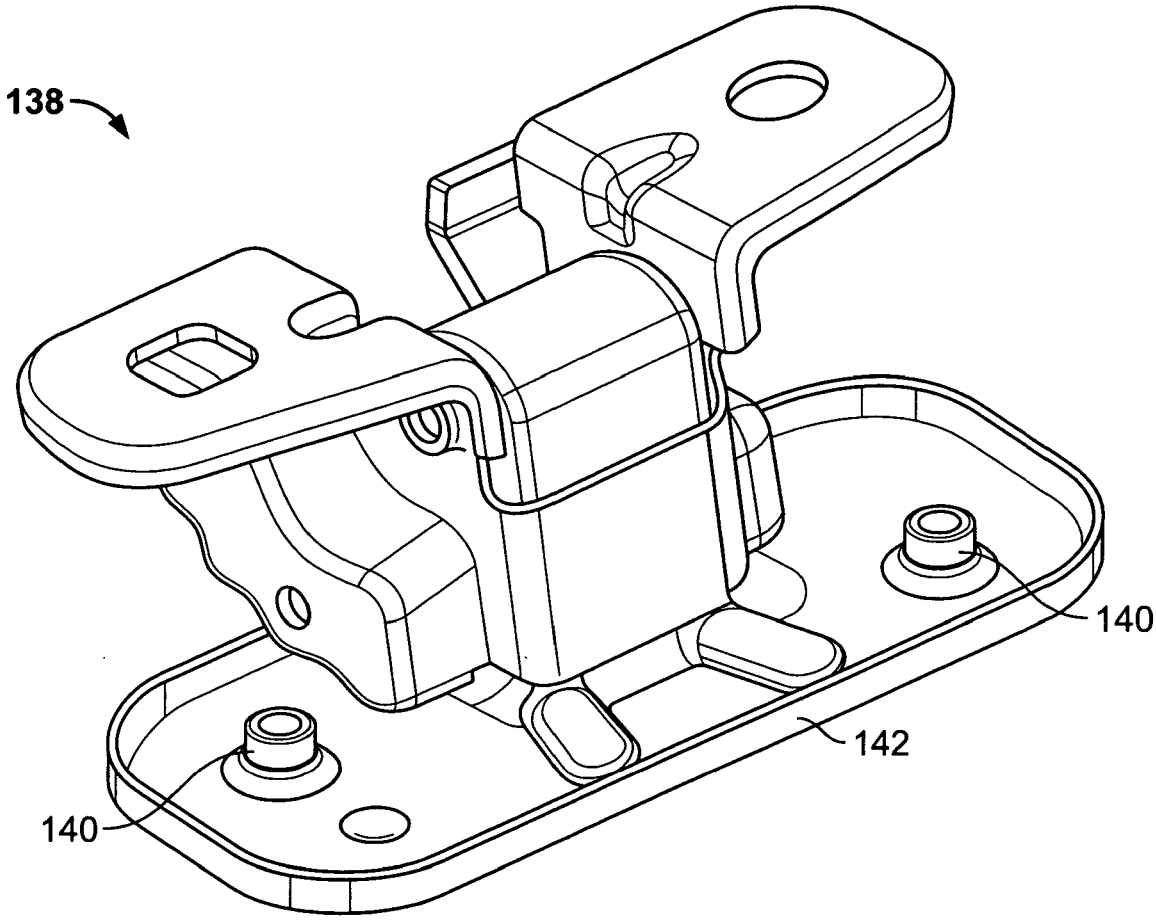
FIG. 15 illustrates a top isometric view of a hinge assembly according to an embodiment of the present invention.

FIG. 15 illustrates a top isometric view of a hinge assembly 138 according to an embodiment of the present invention. The hinge assembly 138 is similar to those described above except that optional threaded draws 140 are integrally formed with the mounting plate 142. The threaded draws 140 are used to threadably secure the mounting plate 142 to a vehicle body.

Figure 16:
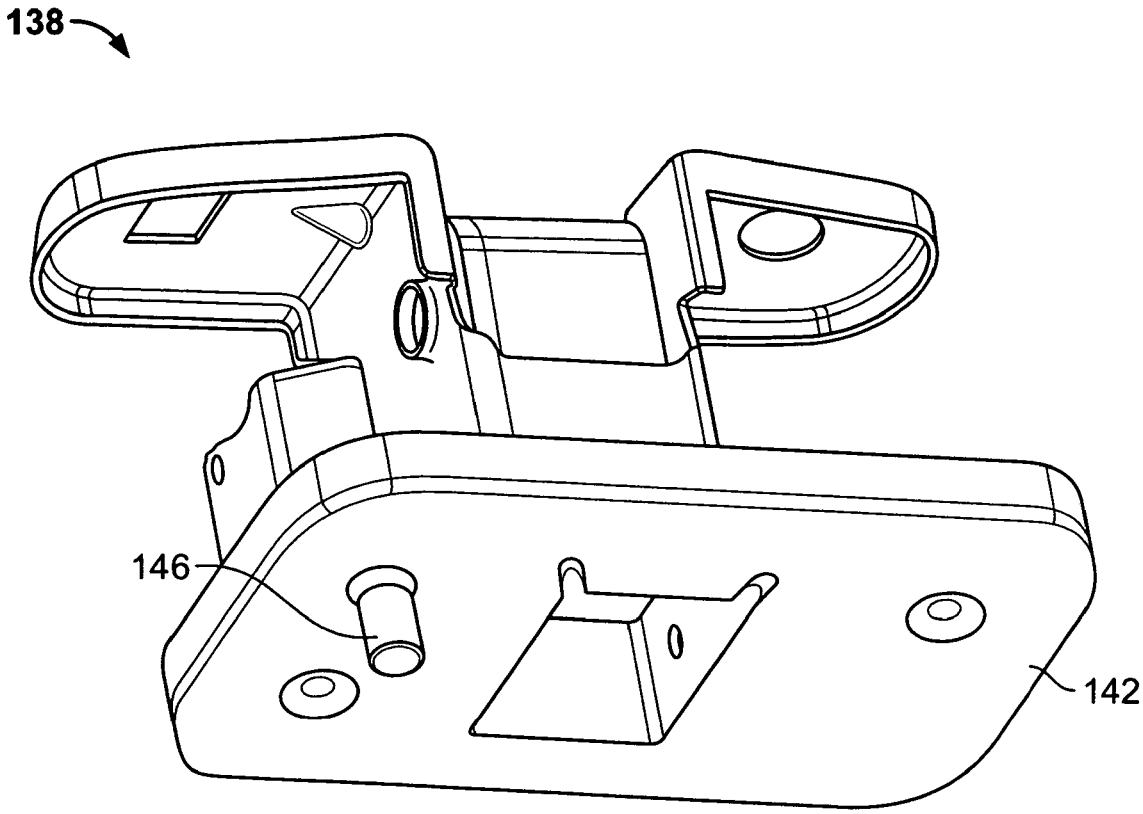
FIG. 16 illustrates a bottom isometric view of a hinge assembly according to an embodiment of the present invention.

FIG. 16 illustrates a bottom isometric view of the hinge assembly 138 according to an embodiment of the present invention. As shown in FIG. 16, the underside of the mounting plate 142 may include at least one downwardly extending locator draw pin 146 used for aligning and properly positioning the mounting plate 142 with respect to the vehicle body.

Embodiments of the present invention provide a hinge assembly that includes an integral check assembly. The check assembly is housed and concealed within the body hinge housing and/or the door hinge housing. Thus, the check assembly may be pre-packaged within the hinge assembly and remains intact while a vehicle that uses the hinge assembly undergoes an e-coat and/or paint process. Additionally, embodiments of the present invention provide a hinge assembly that may move through a wider range of motion than typical hinge assemblies.

While the terms top, bottom, upper, lower, lateral, and the like are used to describe various components of the system, it is understood that such terms are used with respect to the orientations in the drawings. The orientations, however, may be inverted, such that the top is bottom, bottom is top, rear is front, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A hinge assembly comprising:

a door hinge housing configured to be mounted to a door;

a body hinge housing configured to be mounted to a stationary object, said body hinge housing being pivotally secured by a pivot pin to said door hinge housing; and a check assembly adapted to assist in opening and closing the door, said check assembly comprising a spring, and first and second spring housings, said spring being compressed between said first and second spring housings, wherein one of said first and second spring housings retains a roller axle having rollers, and the other of said first and second spring housings includes a pivot pin channel configured to receive an outer surface of said pivot pin, said rollers moving over portions of said door hinge housing during the opening and closing of the door, and wherein said spring is oriented perpendicular to said pivot pin and said roller axle, such that said spring exerts a first force in one direction into one of said first and second spring housings, and such that said spring exerts a second force in an opposite direction into the other of said first and second spring housings, with said pivot pin positioned to exert a force against the associated mating spring housing, said spring, and said first and second spring housings of said check assembly being covered by at least one of said door hinge housing and said body hinge housing.

2. The hinge assembly of claim 1, wherein said door hinge housing is configured to pivot 90° with respect to said body hinge housing.

3. The hinge assembly of claim 1, wherein said first spring housing is fixed within said body hinge housing.

4. The hinge assembly of claim 3, wherein said second spring housing is configured to move relative to said first spring housing.

5. The hinge assembly of claim 1, wherein said door hinge housing comprises arcuate guide tracks having a plurality of dwells separated by a plurality of ridges, said dwells being limit stops for pivotal movement of said door hinge housing with respect to said body hinge housing.

6. The hinge assembly of claim 5, wherein one of said plurality of dwells is configured as a 90° limit stop wherein the door is in a 90° open position.

7. The hinge assembly of claim 5, wherein said plurality of dwells comprises first and second dwells, and wherein a curvature of said first dwell differs from a curvature of said second dwell.

8. The hinge assembly of claim 5, wherein said plurality of ridges comprises first and second ridges, and wherein a size of said first ridge differs from a size of said second ridge.

9. The hinge assembly of claim 1, wherein said body hinge housing comprises a mounting plate integrally formed with a check cover extending from said mounting plate, said check cover covering said spring, and said first and second spring housings.

10. The hinge assembly of claim 1, wherein said check assembly further comprises at least one washer abutting said spring.

11. A hinge assembly comprising:

a door hinge housing configured to be mounted to a door, said door hinge housing comprising an arcuate guide track having a plurality of dwells separated by a plurality of ridges;

a body hinge housing configured to be mounted to a stationary object, said body hinge housing being pivotally secured by a pivot pin to said door hinge housing, said body hinge housing comprising a mounting plate integrally formed with a check cover extending from said mounting plate; and a check assembly adapted to assist in opening and closing the door, said check assembly comprising a first spring housing, a second spring housing, and a spring compressed between said first and second spring housings, said second spring housing being configured to move relative to said first spring housing, wherein one of said first and second spring housings retains a roller axle having rollers, and the other of said first and second spring housings includes a pivot pin channel configured to receive an outer surface of said pivot pin, said rollers moving over said guide track of said door hinge housing during the opening and closing of the door, and wherein said spring is oriented perpendicular to said pivot pin and said roller axle, such that said spring exerts a first force in one direction into one of said first and second spring housings, and such that said spring exerts a second force in an opposite direction into the other of said first and second spring housings, with said pivot pin positioned to exert a force against the associated mating spring housing, said check cover covering said spring, and said first and second spring housings of said check assembly.

12. The hinge assembly of claim 11, wherein said door hinge housing is configured to pivot 90° with respect to said body hinge housing.

13. The hinge assembly of claim 11, wherein at least one of said plurality of dwells is configured as a 90° limit stop wherein the door is in a 90° open position.

14. The hinge assembly of claim 11, wherein said plurality of dwells comprises first and second dwells, wherein a curvature of said first dwell differs from a curvature of said second dwell, wherein said plurality of ridges comprises first and second ridges, and wherein a size of said first ridge differs from a size of said second ridge.

15. The hinge assembly of claim 11, wherein said check assembly further comprises at least one washer abutting said spring.

16. A hinge assembly comprising:

a first hinge housing, said first hinge housing comprising an arcuate guide track having a plurality of detents separated by a plurality of ridges;

a second hinge housing, said second hinge housing being pivotally secured by a pivot pin to said first hinge housing, said second hinge housing comprising a mounting plate integrally formed with a check cover extending from said mounting plate; and a check assembly comprising a first spring housing, a second spring housing, and a spring compressed between said first and second spring housings, said second spring housing being configured to move relative to said first spring housing, one of said first and second spring housings retaining a roller axle having rollers, and the other of said first and second spring housings including a pivot pin channel configured to receive an outer surface of said pivot pin, said rollers moving over said guide track, said spring being oriented perpendicular to said pivot pin and said roller axle, such that said spring exerts a first force in one direction into one of said first and second spring housings, and such that said spring exerts a second force in an opposite direction into the other of said first and second spring housings, with said pivot pin positioned to exert a force against the associated mating spring housing, and said check cover substantially covering said check assembly.

17. The hinge assembly of claim 16, wherein at least one of said plurality of detents is configured as a 90° limit stop wherein the door is in a 90° open position.

18. The hinge assembly of claim 16, wherein said plurality of detents comprises first and second detents, wherein a curvature of said first detent differs from a curvature of said second detent, wherein said plurality of ridges comprises first and second ridges, and wherein a size of said first ridge differs from a size of said second ridge.

19. The hinge assembly of claim 16, wherein said check assembly further comprises at least one washer abutting said spring.

* * * * *